United States Patent [19]

Woosnam

[11] Patent Number: 5,036,912

[45] Date of Patent: Aug. 6, 1991

[54] HEAT EXCHANGER

[75] Inventor: Ian Woosnam, Erdington, England

[73] Assignee: BTR Industries Limited, United Kingdom

[21] Appl. No.: 500,948

[22] Filed: Mar. 29, 1990

[30] Foreign Application Priority Data

Mar. 28, 1989 [GB] United Kingdom ..... 8906908

[51] Int. Cl.[5] ..... F28F 9/04

[52] U.S. Cl. ..... 165/158; 165/69; 165/173; 165/905; 29/890.043

[58] Field of Search ..... 165/69, 158, 905, 173, 165/83

[56] References Cited

U.S. PATENT DOCUMENTS

| | | | |
|---|---|---|---|
| 2,225,856 | 12/1940 | Buck | 165/69 |
| 2,969,956 | 1/1961 | Forgó | 165/162 X/ |
| 3,324,941 | 6/1967 | Divers | 165/173 |
| 4,328,862 | 5/1982 | Gossalter | 165/158 |
| 4,578,850 | 4/1986 | Kerr et al. | 29/157.3 R |
| 4,643,249 | 2/1987 | Grawey | 165/159 |

FOREIGN PATENT DOCUMENTS 0176275 9/1985 European Pat. Off. .

*Primary Examiner*—Allen J. Flanigan

*Attorney, Agent, or Firm*—Stevens, Davis, Miller & Mosher

[57] ABSTRACT

A shell-and-tube type heat exchanger wherein the tube bundle is supported in end members each comprising a layer of elastomeric material sandwiched between two rigid plates. The elastomeric material is capable of swelling under the action of a swelling agent to make good sealing contact with the shell and tubes.

17 Claims, 1 Drawing Sheet

HEAT EXCHANGER

This invention relates to a heat exchanger in which that is exchanged between two fluids. More specifically, this invention relates to a shell and tube type heat exchanger in which a bundle of tubes is housed in an outer shell.

For many years, shell and tube heat exchangers have been constructed from metallic materials. Particularly, the tubes, usually parallel to one another, are disposed and held in a required configuration in a plurality of apertures in end plates. Usually the ends of the tubes are brazed to the end plates but the brazing operation can be costly. The brazed joints are also prone to cracking and leakage due to thermal stresses after prolonged usage. Further, during brazing the metal tubes may be annealed thus reducing their strength.

It is an object of the present invention to provide a heat exchanger in which the effects of the above disadvantages are substantially reduced.

In accordance with the invention, a heat exchanger comprises a shell, a plurality of tubes located within the shell, at least one end member located at an end of the shell and formed with apertures in each one of which an end of one of the tubes is positioned, the end member comprising a layer of elastomeric material sandwiched between two rigid plates maintained at a fixed distance apart, the elastomeric material being constrained by the two plates, the outer peripheral surfaces of the tubes within the apertures and a peripheral restraining surface against its tendency to swell by the action of a swelling agent.

The peripheral restraining surface may be the inner peripheral surface of the shell or an inner surface of an end cover.

The spacing between the two rigid plates may be defined by spacing means which may be located within or on the shell and/or within or on the end cover. For example the spacing means may comprise at least one distance tube mounted on a support plate within the shell or at least one shoulder, ledge or projection on the shell and/or end cover. Alternatively or additionally the spacing between the two rigid plates may be defined by frictional engagement between the outer surfaces of the tubes and the peripheral surfaces of the apertures in the plates.

The elastomeric material is preferably one which, if unconstrained, swells on contact with a swelling agent typically by an amount of the order of at least 25% by volume. However because of the constraint imposed by the two plates and the said outer peripheral surfaces and the restraining surface, the material undergoes only slight swelling. As a result of this slight swelling caused by the agent, the elastomeric material forms a good seal between each rigid plate and the peripheral restraining surface and also between the rigid plates and the external surfaces of the ends of the tubes.

The peripheral restraining surface may be provided with at least one formation, for example, a groove, which is positioned immediately adjacent the periphery of the layer of elastomeric material. On contact with the swelling agent the material swells and the periphery takes up a configuration generally complementary to that of the formation. For example when the formation comprises a groove, on swelling, the periphery becomes formed with a rib which at least partially fills the groove.

According to another aspect of the invention a method of assembling a heat exchanger comprises locating the ends of tubes into respective apertures in an end member comprising a layer of elastomeric material sandwiched between two rigid plates, placing the tubes and end member in a shell and applying a swelling agent to the elastomeric material to cause the material to tend to swell, the material being restrained from swelling its full amount by the rigid plates being spaced apart a pre-determined amount, a peripheral restraining surface and the outer surfaces of the tubes in the end member.

The peripheral restraining surface may be the inner surface of the shell or the end cover of the heat exchanger.

The swelling agent may be a petroleum based fluid such as engine oil and the tubes and end member may be placed in the shell, the end cover placed in position, and the heat exchanger filled with the swelling agent for a sufficient time to cause the elastomeric material to tend to swell but being restrained from so doing and therefore placed in compression. The compressed elastomeric material provides a good seal between the end member and the tube ends, and between the end member and the restraining surface which may be on the shell or cover.

Two embodiments of the invention will now be described by way of example with reference to the accompanying drawings of which:

Figure 1:
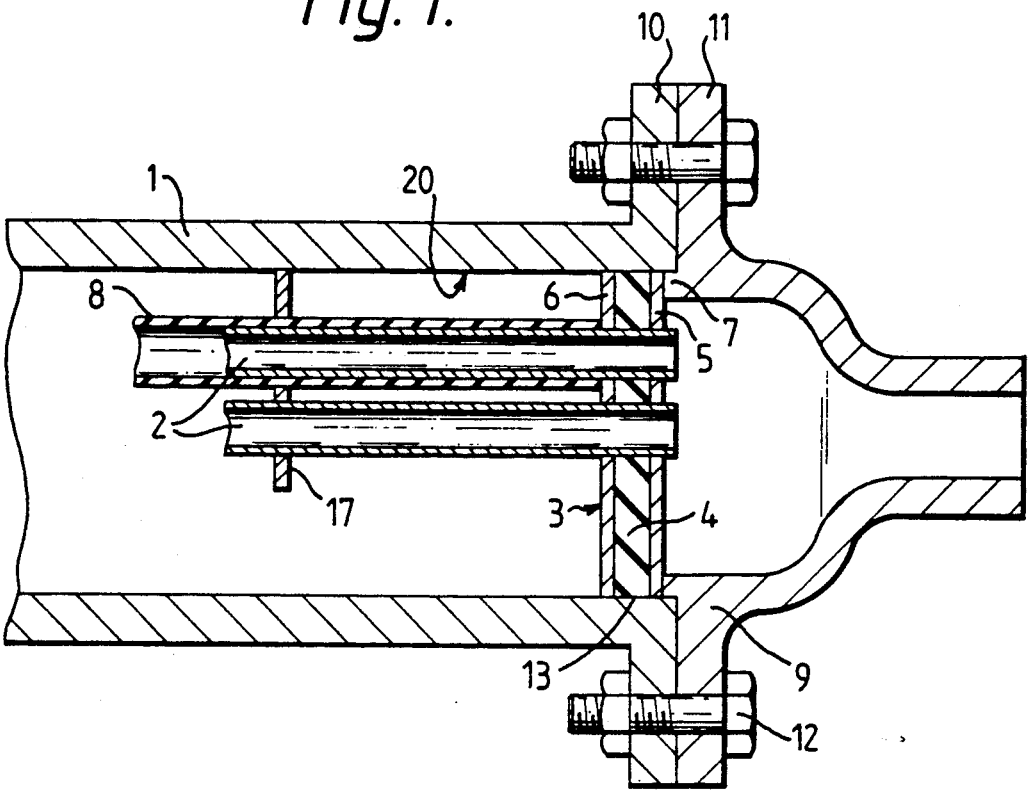
FIG. 1 shows a longitudinal cross-section through the end portion of a heat exchanger in accordance with a first embodiment of the invention.

The heat exchanger shown in FIG. 1 comprises a tubular shell 1 housing a bundle of tubes 2 (only two shown for clarity), the ends of the tubes being held in apertures in an end member 3. The heat exchanger also comprises an end cover 9 fastened to the shell 1 by means of bolts 12 passing through flanges 10, 11 formed on the shell and cover respectively.

The end member 3 comprises a layer of elastomeric material 4, for example ethylene propylene (EP) elastomer, sandwiched between two rigid metallic plates 5, 6. As can be seen in FIG. 1, the end member 3 is located at the end of and within the shell 1. The inner plate 6 rests against the extremities of distance tubes 8 (only one shown) positioned on support plates 17 (only one shown) within the shell, each distance tube being located coaxially outwards of and sheathing one of the heat exchanger tubes 2. The outer plate 5 of the end member 3 rests against a shoulder 7 on the end cover 9. The extremities of the distance tubes 8 and the shoulder 7 define the spacing between the two rigid plates 5, 6.

When the heat exchanger is assembled as shown in FIG. 1 it is filled with a petroleum based oil which seeps through the apertures in the rigid plates and around the ends of the tube and also into the clearance 13 between the outer periphery of the end member 3 and the inner peripheral surface of the shell 1. The elastomeric material starts to swell but is prevented from doing so by the rigid plates 5, 6 which rest against the extremities of the distance tubes 8 and the end cover shoulder 7, the inner peripheral restraining surface 20 of the shell 1 engaging the outer periphery of the elastomeric material and by the outer surfaces of the ends of the tubes 2 engaging the inner peripheral surfaces of the apertures in the elastomeric material. The elastomeric material is thus compressed and seals are formed between the end member and the shell and at the ends of the tubes 2. After a predetermined period sufficiently long to ensure that adequate sealing is effected the heat exchanger is emptied of oil and then placed in service.

Figure 2:
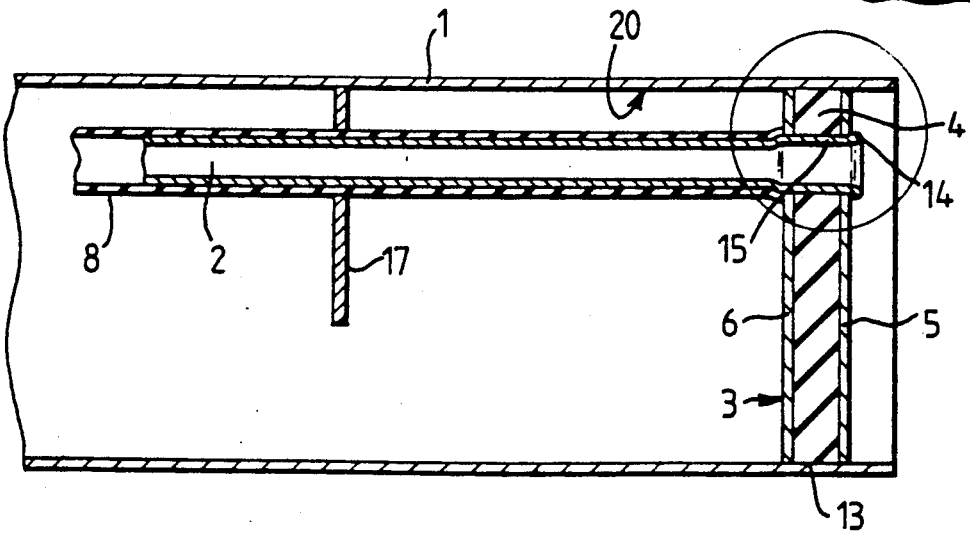
FIG. 2 shows a longitudinal cross-section through part of the end of the shell of a heat exchanger in accordance with a second embodiment of the invention.

The second embodiment of the invention as shown in FIG. 2 also comprises a heat exchanger comprising an outer cylindrical tubular shell 1 housing a bundle of tubes 2 (only one of which is shown for convenience), positioned on support plates 17 (only one shown). Distance tubes 8 are also provided as in the embodiment shown in FIG. 1.

The ends of the tubes 2 are positioned in apertures in an end member 3 comprising a layer 4 of elastomeric material sandwiched between two rigid metallic plates 5, 6 similar to that shown in FIG. 1.

After the ends of the tubes have been placed in the apertures, the end portion located within the end member of each tube is expanded by a suitable forming tool to form an expanded section 15. The extremities of each tube are expanded further to form a bell 14 against which the adjacent end plate 5 is in abutting relationship. The expansion of the tube ends and the forming of the bell 14 brings the outer surfaces of the expanded sections of the tube ends into firm frictional engagement with the inner edges of the apertures in the rigid plates 5, 6 and this initially defines the spacing between the two plates.

The outer peripheral surface of the end member is a close sliding fit inside the shell.

When the heat exchanger has been assembled as shown in FIG. 2 and the end cover fitted it is filled with oil which gradually seeps past the edges of the end plates 5, 6 to contact the elastomeric material 4. This starts to swell but is prevented from doing so fully by the two plates, the inner plate 6 being held firmly by its engagement with the extremities of the distance tubes 8 and the outer plate by its frictional engagement with the expanded section 15 and the bell 14, by the engagement with the inner peripheral restraining surface of the shell at the edge of the end member and by the outer peripheral surface of the enlarged section of each tube in an aperture. The elastomeric material is therefore compressed and good seals are formed against the outer surfaces of the enlarged sections of the tube ends and the inner surface of the shell. Again, as with the first embodiment, after a suitable period of time the heat exchanger is emptied of the oil and may be placed in service.

Figure 3:
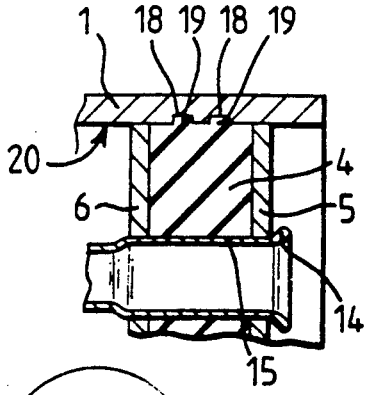
FIG. 3 shows, on an enlarged scale, a modification to the second embodiment of the invention.

A modification of the second embodiment is illustrated in FIG. 3, which is an enlargement of the encircled part of FIG. 2. In this modification the inner peripheral restraining surface 20 is formed with two grooves 18 each of which extends around the whole shell circumference. The elastomeric material 4 of the end member 3 has a smooth, generally cylindrical, peripheral surface when placed in position inside the shell 1, but on contact with the swelling agent, oil, takes up a generally complementary configuration. As can be seen in FIG. 3, two ribs 19 become formed on the periphery of the material, and the edges of the grooves bite in to the material to provide good sealing engagement.

The heat exchangers as described above may comprise oil coolers so that the elastomeric material is continually in contact with oil and is continually tending to swell, so as to maintain the required good seals.

What I claim is:

1. A heat exchanger comprising a shell, a plurality of tubes located within the shell, at least one end member located in an end of the shell and formed with apertures in each one of which an end of one of the tubes is positioned, the end member comprising a layer of elastomeric material sandwiched between two rigid plates maintained at a fixed distance apart, and a swelling agent located between the rigid plates of the end member and contacting the elastomeric material to tend to cause it to swell, the elastomeric material being constrained by the two plates, the outer peripheral surfaces of the tubes within the apertures and a peripheral restraining surface against said tendency to swell.

2. A heat exchanger according to claim 1, wherein the peripheral restraining surface comprises the inner peripheral surface of the shell.

3. A heat exchanger according to claim 1, wherein the peripheral restraining surface comprises an inner surface of an end cover.

4. A heat exchanger according to claim 1, comprising spacing means by means of which the spacing between the two rigid plates is defined.

5. A heat exchanger according to claim 4, wherein the spacing means is partially located within or on the shell.

6. A heat exchanger according to claim 4, wherein the spacing means is partially located within or on an end cover.

7. A heat exchanger according to claim 4, wherein the spacing means comprises at least one distance tube, mounted on a support plate within the shell.

8. A heat exchanger according to claim 4, wherein the spacing means comprises at least one shoulder, ledge, or projection on the shell.

9. A heat exchanger according to claim 4, wherein the spacing means comprises at least one shoulder, ledge, or projection on an end cover.

10. A heat exchanger according to claim 1 wherein the spacing between the two rigid plates is defined by frictional engagement between the outer surfaces of the tubes and the peripheral surfaces of the apertures in the plates.

11. A heat exchanger according to claim 1 wherein the peripheral restraining surface is provided with at least one formation, the elastomeric material taking up a generally complementary configuration on contact with the swelling agent.

12. A heat exchanger according to claim 1, wherein the elastomeric material is one which, if unconstrained, swells on contact with the swelling agent by an amount of the order of at least 25% by volume.

13. A heat exchanger according to claim 1, wherein the swelling agent comprises a petroleum-based fluid.

14. A method of assembling a heat exchanger comprising locating the ends of tubes in respective apertures in an end member comprising a layer of elastomeric material sandwiched between two rigid plates, placing the tubes and end member in a shell and applying a swelling agent to the elastomeric material to cause the material to tend to swell, the material being restrained from swelling its full amount by the rigid plates which are spaced apart a pre-determined amount, a peripheral restraining surface and the outer surfaces of the tube in the end member.

15. A method of assembling a heat exchanger comprising locating the ends of tubes into respective apertures in an end member comprising a layer of elastomeric material sandwiched between two rigid plates, placing the tubes and end member in a shell, at least partially filling the shell with a petroleum-based fluid such as engine oil, retaining the fluid in contact with the elastomeric material for a sufficient time to cause the elastomeric material to tend to swell but being restrained from so doing and therefore placed in compression by its engagement with the rigid plates which are spaced apart a pre-determined amount, a peripheral restraining surface and the outer surface of the tubes in the end member.

16. A method of assembling a heat exchanger according to claim 14 wherein the peripheral restraining surface is provided with at least one formation and the swelling agent causes the elastomeric material to take up a complementary configuration.

17. A method of assembling a heat exchanger according to claim 15 wherein the peripheral restraining surface is provided with at least one formation and the swelling agent causes the elastomeric material to take up a complementary configuration.

* * * * *